US011371748B2

(12) United States Patent
Green

(10) Patent No.: US 11,371,748 B2
(45) Date of Patent: Jun. 28, 2022

(54) PORTABLE HEATER WITH CERAMIC SUBSTRATE

(71) Applicant: Jeff Green, Beverly Hills, CA (US)

(72) Inventor: Jeff Green, Beverly Hills, CA (US)

(73) Assignee: The Merchant of Tennis, Inc., Beverly Hills, CA (US)

( * ) Notice: Subject to any disclaimer, the term of this patent is extended or adjusted under 35 U.S.C. 154(b) by 295 days.

(21) Appl. No.: 16/532,294

(22) Filed: Aug. 5, 2019

(65) Prior Publication Data

US 2021/0041140 A1 Feb. 11, 2021

(51) Int. Cl.

| | |
|---|---|
| ***F24H 3/00*** | (2022.01) |
| ***F24D 19/02*** | (2006.01) |
| ***F24D 15/02*** | (2006.01) |
| ***F24C 7/06*** | (2006.01) |

(52) U.S. Cl.

CPC ..... *F24H 3/002* (2013.01); *F24C 7/065* (2013.01); *F24D 15/02* (2013.01); *F24D 19/02* (2013.01)

(58) Field of Classification Search

None

See application file for complete search history.

(56) References Cited

U.S. PATENT DOCUMENTS 1,255,814 A 2/1918 Brown
1,398,217 A 11/1921 Brown et al.
1,462,380 A 7/1923 Richardson
1,540,007 A 6/1925 Homeyer
1,547,647 A * 7/1925 Furfaro ..... F24C 7/065 392/440
1,840,918 A * 1/1932 Seale ..... F24H 3/0417 392/429
1,917,461 A * 7/1933 Rankin ..... F24C 7/065 392/428
2,010,958 A 8/1935 Marshall
2,073,582 A 3/1937 Morse
2,334,501 A * 11/1943 Moeller ..... F24H 3/0417 392/376
2,467,479 A 4/1949 Huck
2,512,061 A 6/1950 Huck
2,631,217 A 3/1953 Aufiero
2,827,539 A * 3/1958 Smith ..... G01N 21/255 250/495.1
3,068,341 A 12/1962 Ortiz et al.
3,077,531 A 2/1963 Wompey
3,525,850 A * 8/1970 Hager, Jr. ..... H05B 3/00 392/433
3,540,429 A 11/1970 Svensson et al.
3,612,828 A 10/1971 Siegla
3,635,147 A * 1/1972 Lee ..... A47J 27/14 99/348

(Continued)

*Primary Examiner* — Thor S Campbell

(74) *Attorney, Agent, or Firm* — Lewis Roca Rothgerber Christie LLP

(57) ABSTRACT

A portable heater that includes a ceramic substrate with a heating element configured to define a field of direct radiation, a heat reflector with a concave reflective surface configured to define a field of reflective radiation, a grill cover mounted on the heat reflector, where the ceramic substrate is mounted on an interior side of the grill cover with the heating element facing the concave reflective surface such that the field of direct radiation onto the concave reflective surface is unobstructed.

28 Claims, 7 Drawing Sheets

(56) References Cited

U.S. PATENT DOCUMENTS 4,010,348 A * 3/1977 Salinger ..... F24C 7/065 392/423
4,115,177 A * 9/1978 Nelson ..... F24S 23/82 156/245
4,563,572 A * 1/1986 Hager, Jr. ..... F24C 7/065 219/200
5,408,574 A 4/1995 Deevi et al.
5,616,024 A 4/1997 Nobori et al.
5,647,664 A * 7/1997 Hanecka ..... F21S 41/365 362/308
6,084,550 A * 7/2000 Jones ..... H01Q 1/125 343/704
6,137,446 A * 10/2000 Jones ..... H01Q 1/02 343/704
6,188,836 B1 * 2/2001 Glucksman ..... F28F 13/18 392/376
6,215,956 B1 * 4/2001 Lee ..... F24C 7/065 392/373
6,245,010 B1 6/2001 Jones
6,304,719 B1 * 10/2001 Mo ..... F24C 7/065 248/161
6,317,088 B1 * 11/2001 Lindsay ..... H01Q 1/02 343/704
6,324,340 B1 * 11/2001 Kim ..... F04D 29/582 392/361
D456,067 S 4/2002 Kalina et al.
6,392,205 B1 * 5/2002 Minonishi ..... H01L 21/67103 219/443.1
6,526,227 B2 * 2/2003 Choi ..... H05B 3/009 219/541
6,585,636 B2 7/2003 Jones et al.
6,835,916 B2 12/2004 Ito et al.
D633,189 S 2/2011 Berge et al.
8,107,797 B2 * 1/2012 Abodreham ..... F24H 3/0411 392/361
8,269,150 B2 9/2012 Kim et al.
8,479,515 B2 * 7/2013 Coffey ..... F24S 30/40 60/641.11
10,137,759 B2 * 11/2018 Jung ..... B60H 1/2215
2002/0003952 A1 * 1/2002 Choi ..... F04D 29/584 392/376
2003/0128972 A1 7/2003 Choi
2004/0074893 A1 4/2004 Wermbter et al.
2004/0206747 A1 10/2004 Ito

* cited by examiner

PORTABLE HEATER WITH CERAMIC SUBSTRATE

FIELD

The present disclosure relates generally to space heaters, and specifically to portable electric space heaters with a ceramic substrate.

BACKGROUND

Electric radiant heaters are generally used to convert electric current into heat for several applications including space heating. Generally, an electric space heater has a resistive heating element which releases radiant energy toward a reflector which subsequently redirects the energy away from the heater. The redirected energy travels through air or space to warm people or objects in a room, making it desirable for a variety of applications. However, these heaters tend to be silent and present a danger of igniting nearby furnishings due to the intensity of their heat output and lack of safety features. Moreover, these heaters may pose a danger to a child or careless adolescent who fails to appreciate the silent danger posed by direct contact with the resistive heating element. Therefore, designing an efficient, portable electric space heater to provide task-specific heating with enhanced safety features can be challenging.

Ceramic heating discs are known. Heating apparatuses of this type may include a ceramic heater with a high melting point metallic wire embedded within a dense ceramic disc-shaped substrate. The wire within the disc-shape substrate may be connected at both ends to terminals.

SUMMARY

The present disclosure is directed to various embodiments of a portable heater that includes a ceramic substrate with a heating element configured to define a field of direct radiation, a heat reflector with a concave reflective surface configured to define a field of reflective radiation, a grill cover mounted on the heat reflector, where the ceramic substrate is mounted on an interior side of the grill cover with the heating element facing the concave reflective surface such that the field of direct radiation onto the concave reflective surface is unobstructed.

In some embodiments, the portable heater includes a wire conduit extending from the ceramic substrate to a periphery of the heat reflector, remaining outside of the field of radiation of the ceramic substrate.

In some embodiments, the grill cover has a predetermined profile and the wire conduit is coextensive with the grill with the predetermined profile.

In some embodiments, the ceramic substrate is supported in its entirety by the grill cover.

In some embodiments, a center axis extends between a center of the ceramic substrate and a center of the heat reflector and the portable heater is without a support structure extending directly between the ceramic substrate and the heat reflector that is coextensive with the center axis.

In some embodiments, a center axis extends between a center of the ceramic substrate and a center of the heat reflector, and the portable heater is without a support structure that extends directly between the ceramic substrate and the heat reflector and is generally parallel with the center axis.

In some embodiments, the heating element is provided on an inner surface of the ceramic substrate, where the inner surface is generally perpendicular to the center axis.

In some embodiments, the heating element is provided on an inner surface of the ceramic substrate, where the inner surface is without an azimuthal surface relative to the center axis.

In some embodiments, the heating element of the ceramic substrate is positioned to radiate onto a center main portion of the heat reflector without obstruction.

In some embodiments, a portable heater includes a heat reflector with a concave reflective surface configured to define a field of reflective radiation, a grill mounted on the heat reflector, and a ceramic substrate with a heating element configured to define a field of direct radiation, where the concave reflective surface has a center main portion and the ceramic substrate is mounted on an interior side of the grill with the heating element facing the concave reflective surface such that the center main portion of the concave reflective surface is exposed in its entirety to the field of direct radiation.

In some embodiments, the field of direct radiation has generally parallel lines of radiation and the field of reflective radiation has nonparallel lines of radiation.

In some embodiments, the nonparallel lines of radiation includes dispersive lines of radiation outside of the field of direct radiation.

In some embodiments, depending on the distance between the resistive heating element on the ceramic substrate and the heat reflector, the heat reflector is configured so that 90% to substantially all of radiant heat produced by the resistive heating element and directed toward the heat reflector is redirected away from the heat reflector.

This summary is provided to introduce a selection of features and concepts of embodiments of the present disclosure that are further described below in the detailed description. This summary is not intended to identify key or essential features of the claimed subject matter, nor is it intended to be used in limiting the scope of the claimed subject matter. One or more of the described features may be combined with one or more other described features to provide a workable device.

DETAILED DESCRIPTION

Figure 1:
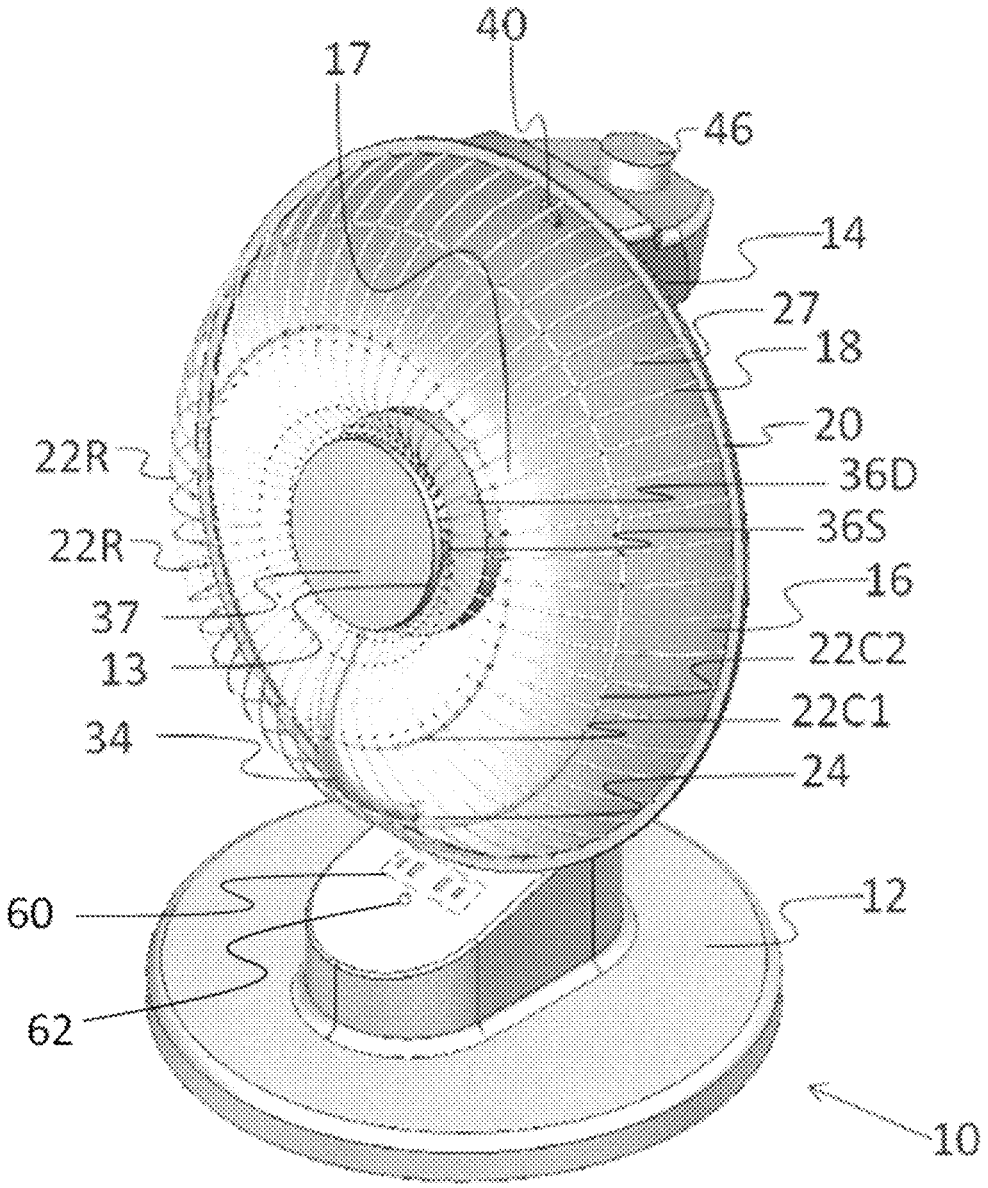
FIG. 1 illustrates a perspective view of a portable heater according to one embodiment of the present disclosure.
Figure 2:
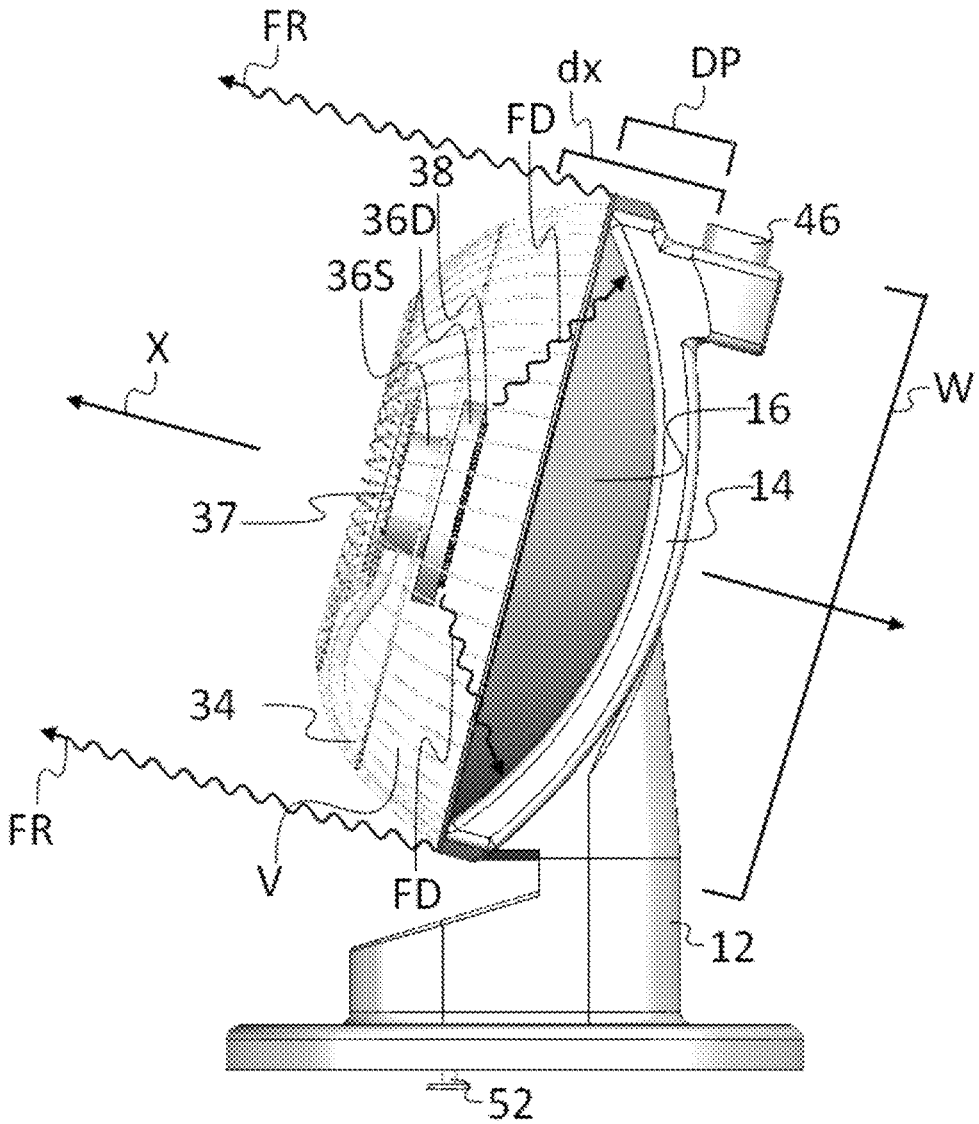
FIG. 2 is a side view of the portable heater illustrated in FIG. 1.
Figure 3:
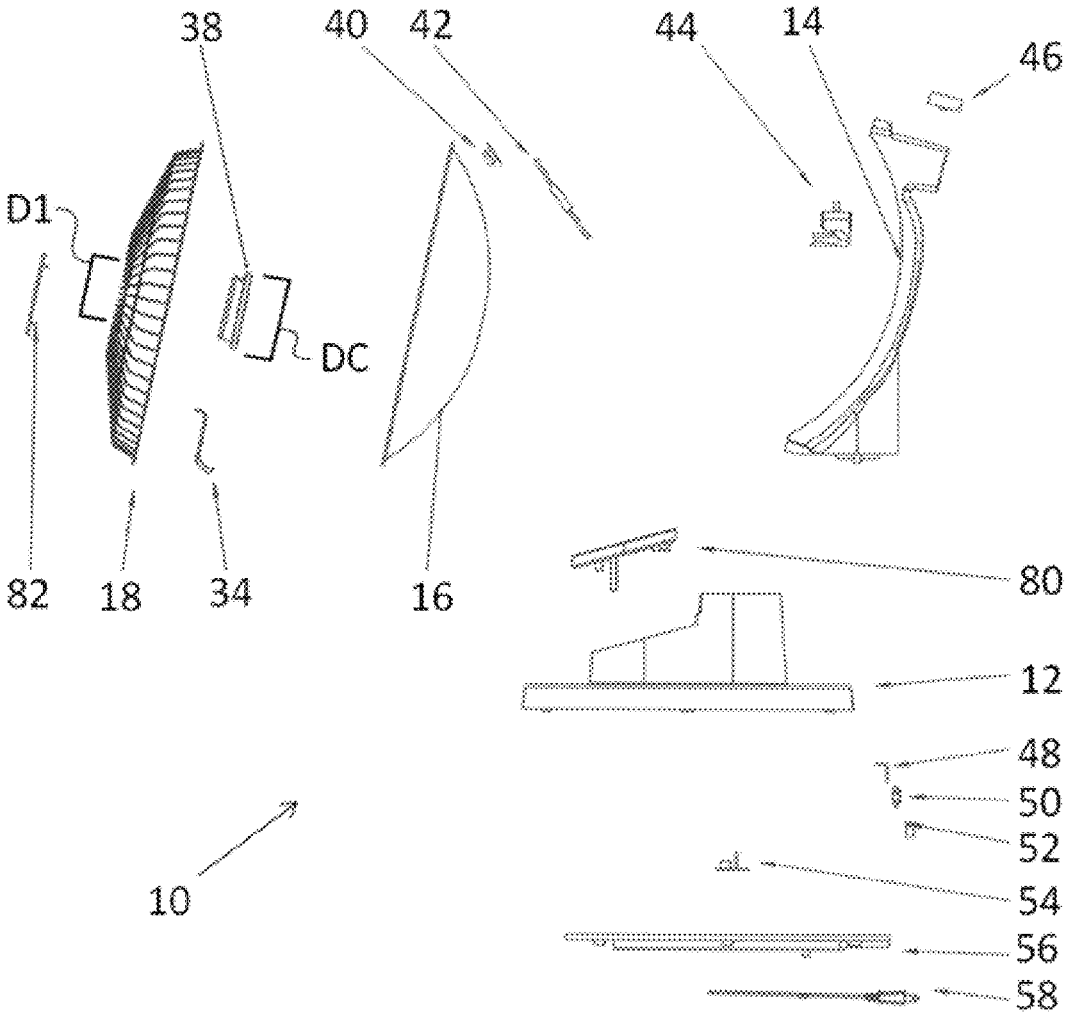
FIG. 3 is an exploded side view of the portable heater illustrated in FIG. 1.

With reference now to FIG. 1, FIG. 2, and FIG. 3, a portable heater 10 according to some embodiments of the present disclosure includes a dish or heat reflector 16, a ceramic substrate 36 with a resistive heating element 38, a base 12 and a stand 14 on which the heat reflector 16 is mounted. The heat reflector 16 has a front (or inner) heat-reflective surface 17 with a predetermined concave configuration. The heater 10 also includes a grill cover 18 that extends over the heat reflector 16. The grill cover 18 has a predetermined contour, for example, a generally dome-shape, formed by a plurality of rails 22 defining a concavity on an inner side 25 that faces the heat-reflective surface 17 of the heat reflector 16, and an outside surface 27 that faces away from the heat-reflective surface 17. A peripheral rim 23 of the grill cover 18 engages or otherwise meets with a corresponding peripheral rim 20 of the heat reflector 16 so that the grill cover and the heat reflector are in a fixed relationship with each other in defining an interior volume V therebetween.

In some embodiments, the heat reflector 16 is supported by the stand 14 that extends from the base 12. The heat reflector 16 is received and sits in the stand and is fixed thereto as understood in the art (FIG. 3). The stand 14 orients the heat reflector 16 at a desired angle to substantially redirect heat uniformly in a forward direction to behind the ceramic substrate 36 and the heating element 38. In other embodiments, the stand 14 and the base 12 are configured to allow the user to adjust the orientation angle of the heat reflector, for example, by a ball and socket mechanism, hinge joint, or the like.

In some embodiments, the rails 22 are arranged in a screen pattern with voids or space gaps between adjacent rails. The screen pattern also includes a center opening 13 with a diameter D1 for mounting the ceramic substrate 36. The ceramic substrate 36 is supported on a body having a disc 36D with a diameter D2 and a stem 36S with a diameter D3, where D3<D1<D2. The disc 36D is positioned on the inside surface 25 of the grill cover 18 with the resistive heating element 38 facing the heat reflector 16. An end portion of the stem 36S extends through the center opening 13. A backing plate 37 with a diameter D4>D1 is positioned on the outer surface 27 of the grill cover 18 where the backing plate 37 is affixed to the stem 36S so as to secure the ceramic substrate 36 to the center opening 13 of the grill cover 18. These components are configured so that a center axis X extends through a center of the ceramic substrate 36, a center of the opening 13 and a center of the heat reflector 16. The stem 36S and the backing plate 37 are configured for locking engagement with each other and the grill cover 18 so as to prevent translational movement of the ceramic substrate 36 along the center axis X and/or rotational movement of the ceramic substrate 36 about the axis X relative to the grill cover 18. Securely mounted to the grill cover 18, the ceramic substrate 36 needs no other support structure to maintain its spatial position and orientation relative to the heat reflector 16. It is understood that the center opening 13 and the stem 36S may be shaped and sized as desired or appropriate so that the stem 36S can extend through the center opening 13. It also understood that the disc 36D and the backing plate 37 may have any suitable cross-sectional shape, e.g., circular, rectangular or polygonal configuration, as desired or appropriate.

Advantageously, the larger diameter of the disc 36D and the ceramic substrate 36 help shield the stem 36S and the backing plate 37 from the heat that is redirected forwardly by the heat reflector 16. The ceramic substrate 36 is composed of any suitable insulation material for reducing heat conduction through the ceramic substrate.

In some embodiments, the rails 22 include a plurality of spaced-apart radial rails 22R and a plurality of spaced-apart concentric rails 22C. The spacing between rails is in compliance with known safety standards. Accordingly, only objects of a predetermined limited size can pass through the space gaps between the rails, as a safety feature of the heater 10 in minimizing the risk of injury to a user and/or damage to the ceramic substrate 36 and the heating element 38. That is, the arrangement of the rails forms a rigid screen preventing a user from inserting objects past the grill cover. Moreover, a child is substantially prevented from touching dangerous components inside the grill cover.

In some embodiments, the grill cover 18 includes 56 radial rails. The grill cover 18 may also include an inner concentric rail 22C1 and an outer concentric rail 22C2 to provide support to the radial rails 22R and help maintain their spatial separation from each other and the overall structural integrity of the grill cover 18.

With the ceramic substrate 36 and its resistive heating element 38 directly facing the inner reflective surface 17 of the heat reflector 16, where an inner surface 39 of the ceramic substrate 36 in which the heating element 38 is embedded is generally perpendicular to the center axis X, the ceramic substrate 36 defines a generally conical field of direct radiation FD within which radiant heat emitted by the heating element 38 can travel directly and unimpeded to reach the heat reflector 16. The field of direct radiation FD is advantageously free from any obstruction, and the portion of the heat-reflective surface 17 in the field of direct direction is also advantageously free from any obstruction because the ceramic substrate 36 is supported by the grill cover 18 so that all or nearly all of the radiant heat emitted by the heating element 38 can reach the heat-reflective surface 17 of the heat reflector 16 without interruption, obstruction, scattering and/or redirection for improved energy efficiency in the operation of the heater 10. As such, the heater 10 is without a structure or component that is within the field of direct radiation FD or extends through it. As better shown in FIG. 2, the interior volume V of the heater 10 is without any structure or component that is coextensive or generally parallel with the center axis X.

As another advantageous feature of the heater 10, the heater is configured to minimize the risk of significant contact between the heating element 38 and objects that may be inserted into the interior volume V of the heater. With the ceramic substrate 36 facing the heat-reflective surface 17 of the heat reflector 16 and generally perpendicular to the center axis X, the heating element 38 avoids exposure from any side (circumferential) angle about the center axis X. As better seen in FIG. 2, only a minimal side profile of the outermost portions of the heating element 38 is exposed. Thus, the risk of a child inserting an object into the interior volume V through the grill cover 18 and making contact the heating element is greatly minimized. An insertion of a straight object would risk contact with only the side profile of the outermost portions of the heating element 38. Contact between any object and the inner portions of the heating element 38 would require some not insignificant degree of effort and deftness.

Furthermore, with only the minimal side profile of the outermost portions of the heating element 38 being visible from the side (circumferential) angle, the visible glow of the heating element when the heater is operating which may be disruptive or displeasing to some users is also minimized in the heater 10.

With all or nearly all of the radiant heat from the heating element 38 reaching the reflective surface 17 of the heat reflector 16, the heat reflector 16 is configured to redirect the radiant heat toward the front of the heater 10 in a predetermined manner according to the configuration of the reflective surface 17.

Figure 6:
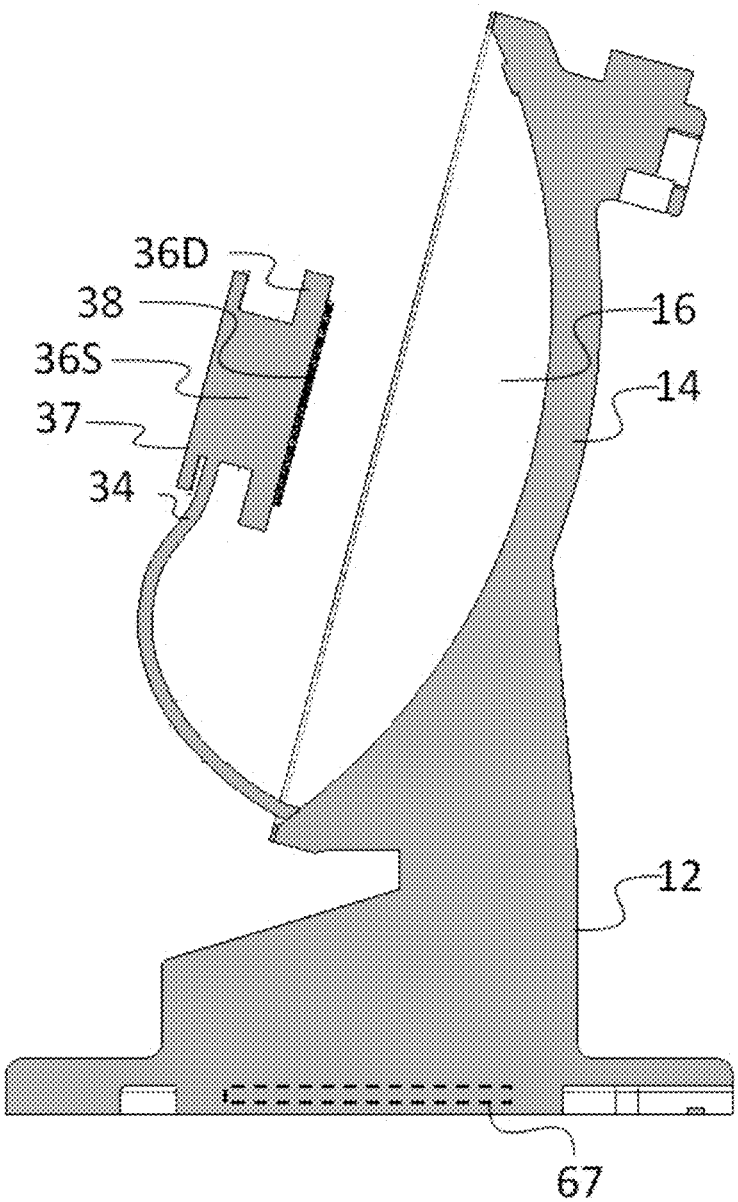
FIG. 6 is a cross-sectional view taken along line A-A illustrated in FIG. 1 with the grill guard hidden according to one embodiment of the present disclosure.

With reference now to FIG. 6, according to some embodiments, the center of the resistive heating element 38 and the center of the reflective surface 17 is separated by a predetermined distance dx ranging between about 4.5 inches and 4.75 inches, where the diameter DC of the ceramic substrate is about 4.75 inches. The separation distance dx is sufficient to allow the heat reflector 16 to redirect about 90% of the radiant heat produced by the resistive heating element 38. In some embodiments, the distance dx enables the heat reflector 16 to redirect substantially all of the radiant heat produced by the resistive heating element 38.

In some embodiments, as shown in FIG. 2, the heat reflector 16 has a width W of about 16 inches and a depth DP of about 4 inches, with a curvature that traces an arc of a circle having a radius R of about 10 inches. The heat reflector 16 is configured to provide a field of redirected radiation FR that has substantially uniform heating to a vertical plane perpendicular to the axis X of the heat reflector 16. In one embodiment, as shown in Table I, a vertical foil with seven separate test probes approximately 10 feet away from the portable heater 10 measured temperature variability less than 2 degrees Fahrenheit.

TABLE I

| | TEMPERATURE (° F.) | | | | | | |
|---|---|---|---|---|---|---|---|
| Duration | CH1 | CH2 | CH3 | CH4 | CH5 | CH6 | CH7 |
| 1 MIN | 68.1 | 67.8 | 67.2 | 67.1 | 66.5 | 66.7 | 67.2 |
| 10 MIN | 73.9 | 73.2 | 73 | 72.8 | 73.6 | 72.8 | 72.9 |
| 0.5 Hr | 74.8 | 74.3 | 74.2 | 74 | 73.9 | 73.6 | 73.3 |
| 0.75 Hr | 75.2 | 74.8 | 74 | 74.2 | 74.6 | 74.7 | 74.9 |
| 1 Hr | 74.8 | 74.9 | 75 | 74.6 | 75.6 | 75.1 | 74.6 |
| 1.5 Hr | 74.6 | 75 | 75.2 | 74.8 | 74.7 | 75 | 75.1 |
| 2 Hr | 75.2 | 75.6 | 74.8 | 74.6 | 75.2 | 74.7 | 74.9 |
| 2.5 Hr | 74.7 | 75 | 74.9 | 74.7 | 75.7 | 74.6 | 74.1 |
| 3 Hr | 75.3 | 75.7 | 74.9 | 75.7 | 75.2 | 74.9 | 74 |
| 3.5 Hr | 74.8 | 75 | 74.3 | 74.7 | 75 | 74.6 | 74.7 |
| Average | 74.14 | 74.13 | 73.75 | 73.72 | 74 | 73.67 | 73.57 |

In some embodiments, the disc 36D and the stem 36S supporting the ceramic substrate 36, the rails 22 and the heat reflector 18 may be constructed of a suitable material, including stainless steel or aluminum.

Figure 7:
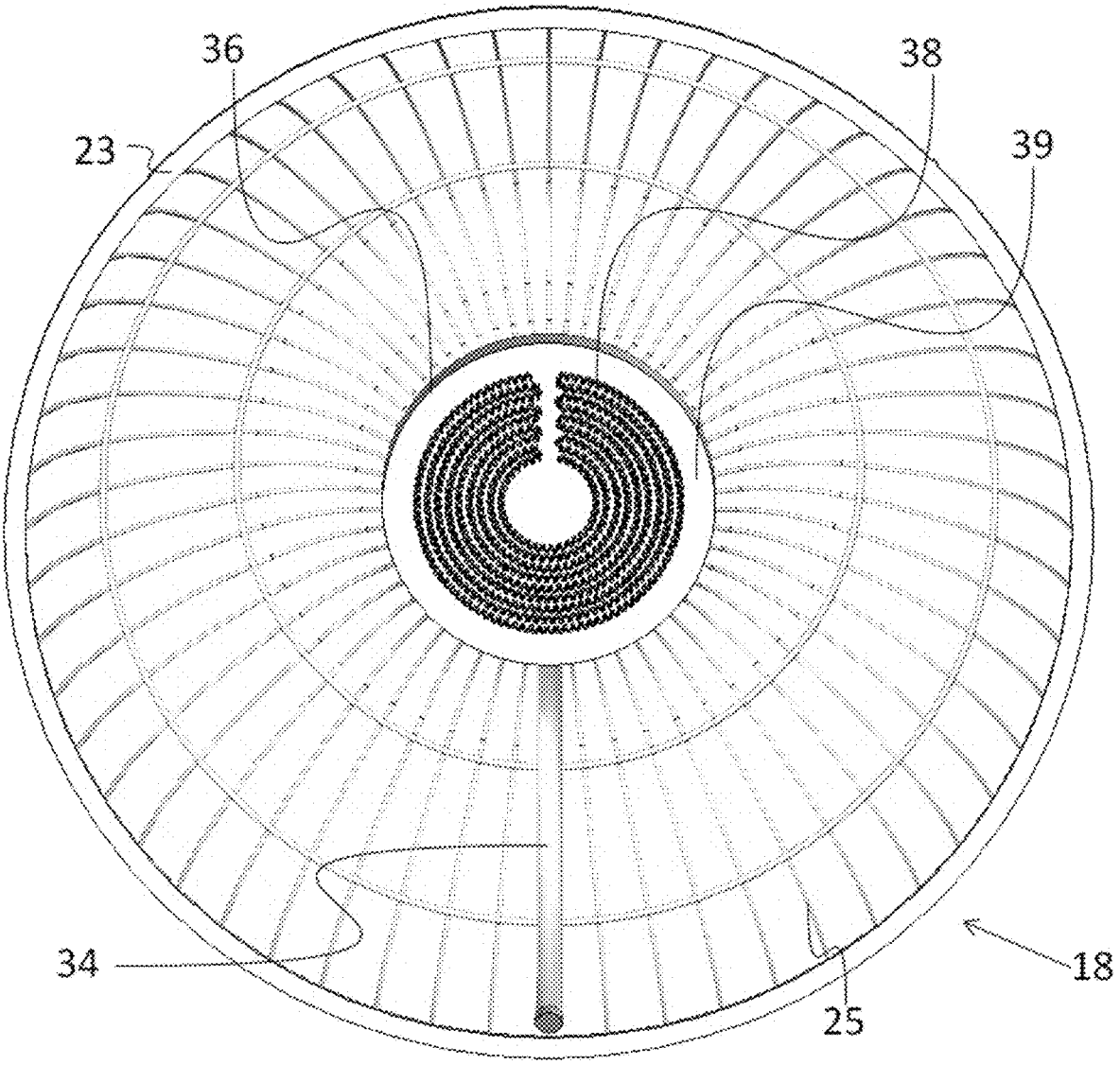
FIG. 7 is a rear view of the grill guard, line pipe, and ceramic substrate of the embodiment of the portable heater in FIG. 1.

With reference now to FIG. 7, the resistive heating element 38 according to some embodiments of the present disclosure is a substantially flat, ribbed resistive heating element. The ribs are set to a desired height and width to efficiently use space and maximize exposed surface area to increase the intensity of radiant heat emitted by the resistive heating element 38. In the illustrated embodiment, the resistive heating element 38 is arranged in a circular pattern corresponding to the shape of the heat reflector 16 and the ceramic substrate 36. By efficiently using space available on the ceramic substrate 36, the ceramic substrate 36 may be smaller size thereby reducing convective heat loss from the ceramic substrate 36 and allowing more radiant heat redirected by the heat reflector 16 to escape in the generally forward direction. In the illustrated embodiment, the resisting heating element 38 is a metallic ribbon crimped to provide increased length and surface area relative to the size of the ceramic substrate 36 for higher power density, as understood in the art.

In some embodiments, the resistive heating element 38 is powered at terminals located near the center of the ceramic substrate 36. The terminals extend into the ceramic substrate to electrically connect to the one or more insulated wires protected by the line pipe 38 in the ceramic substrate 36.

As understood in the art, the resistive heating element 38 on the disc 36D of the ceramic substrate 36 is constructed of any suitable material for converting electric current into heat as electric current flows through the material. For example, the resistive heating element 38 may be composed of an alloy of metals chosen for limited conductivity and thus emission of heat when electric power is applied. With the resistive heating element 38 embedded in the ceramic substrate 36, the ceramic substrate functions as a thermal insulator thereby reducing the conduction of heat from the heating element 38 directly to the grill cover 18 and protecting the grill cover 18 from resistive heating and heating to unsafe temperature.

In some embodiments, a line pipe 34 encapsulating, enclosing, or securing one or more insulated wires supplying current to the heating element 38 is coupled at one end to the ceramic substrate 36 and coupled at another end to a peripheral region 24 of heat reflector 16. By coupling to the peripheral region 24 of the heat reflector 16, the line pipe 34 increases the available reflective surface area, including area at the center of the heat reflector 16, for redirecting radiant heat. In some embodiments, the line pipe 34 is coupled to the peripheral rim 20 in the peripheral region 24 of the heat reflector 16. Although in the illustrated embodiment, the line pipe 34 is coupled to the peripheral region 24 of the heat reflector 16, in some embodiments, the line pipe 34 is coupled to another suitable component of the portable heater 10, for example, the base 12 or the stand 14. In the illustrated embodiment, the line pipe 34 may assist in stabilizing the ceramic substrate 36 mounted on the grill cover 18. Although, in the illustrated embodiment, the line pipe 34 is a single line pipe coupled to a lower portion of the periphery of the heat reflector 16, in some embodiments, one or more line pipes may be coupled at any location in the peripheral region 24 of the heat reflector 16. In any case, the line pipe 34 is generally coextensive with the grill cover 18 closely following the contour of the grill cover 18 and therefore remains outside of the field of direct radiation between the heating element 38 and the heat reflector 16. The pipe line 34 may be a rigid structure or a flexible as desired or appropriate.

With reference now to FIGS. 3 and 3B, a tip-over switch 50, a thermal fuse 42, and an adjustable thermostat are connected in series between a live terminal L and a neutral terminal N. In the event that the tip-over switch 50 disconnects, the thermal fuse 42 is blown, and/or the adjustable thermostat (e.g., adjusted using a potentiometer, a variable resistor, etc.) substantially prevents current flow, the resistive heating element 38 and a printed circuit board 54 are deactivated. In some embodiments, the printed circuit board 54 is connected to an audio alarm or buzzer 60 and a visual indicator light 62 (FIG. 1) provided on a panel cover 80 of the base 12. When each is active depending on the arrangement of components of the printed circuit board 54, the buzzer releases an audible noise and the indicator light may blink intermittently.

In some embodiments, the resistive heating element 38 and an automatic thermostat 40 are connected in series. In the event that the automatic thermostat 40 disconnects, the resistive heating element 38 is shut down. However, because the printed circuit board 54 and the automatic thermostat 40 are in parallel, in some embodiments, the printed circuit board 54 may remain powered despite the resistive heating element 38 being deactivated. Therefore, the buzzer and the indicator light connected to the printed circuit board 54 may still be activate depending on the arrangement of components of the printed circuit board 54. In some embodiments, the sound of the buzzer and/or the glare from the blinking light warns users that the portable heater 10 may be in an unsafe position or at an unsafe temperature. In other embodiments, the buzzer and/or the blinking light may warn users that the resistive heating element 38 is active.

Figure 4:
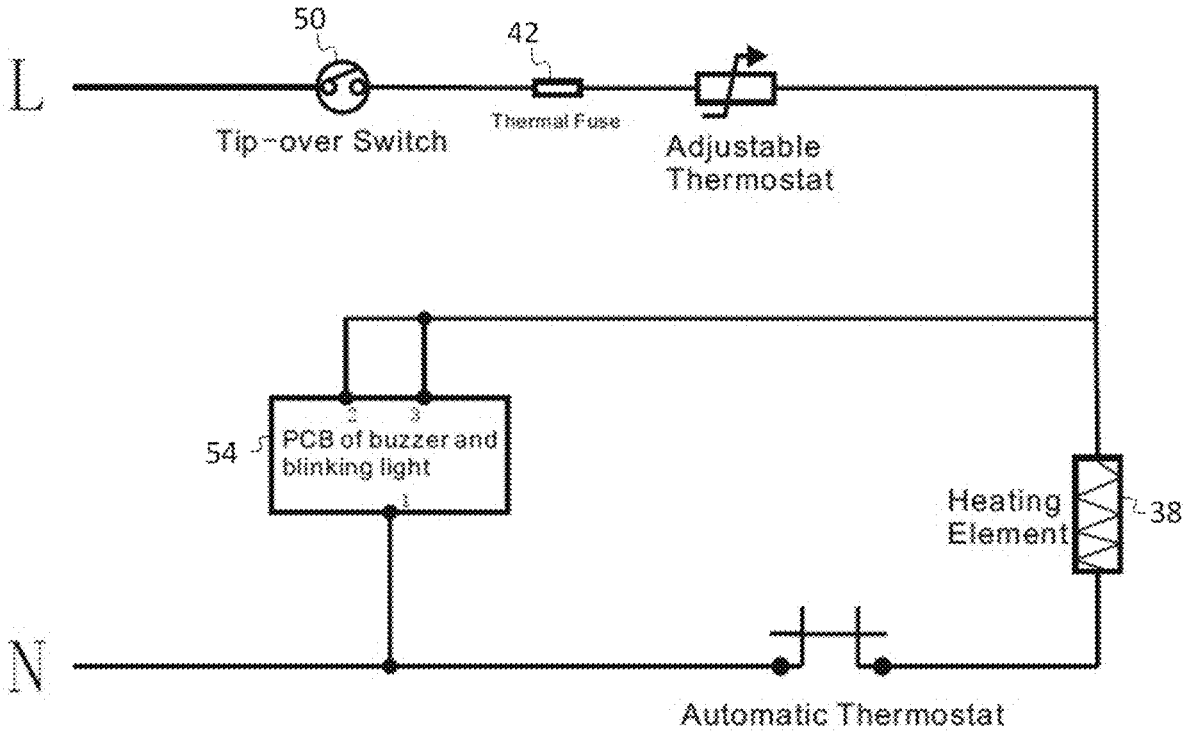
FIG. 4 is a schematic electrical diagram of components of the portable heater illustrated in FIG. 1.

As shown in FIG. 3, the base 12 of the portable heater 10 includes a switch bracket 48, the tip-over switch 50, a plunger 52, and the printed circuit board 54. When the portable heater 10 is powered on and is upright on a flat surface, the plunger 52 is held in place by abutting against the flat surface. While the plunger 52 is held in place, the tip-over switch 50 completes the circuit shown in FIG. 4. If the portable heater 10 tips over, the plunger 52 is no longer restrained and subsequently extends away from the base 12 of the portable heater 10. When the plunger 52 is extended, the tip-over switch 50 disconnects the live terminal L from the resistive heating element 38 thereby causing the resistive heating element 38 to lose power.

In some embodiments, the heat reflector 16 includes a thermal fuse 42. If the temperature of the thermal fuse 42 exceeds an upper temperature threshold, then the thermal fuse 42 melts and breaks the connection between the resistive heating element 38 and the live terminal L which causes the resistive heating element 38 to lose power.

In some embodiments, the heat reflector 16 includes an automatic thermostat 40. The automatic thermostat 40 measures the temperature at the back surface of the heat reflector 16. If the temperature measured by the automatic thermostat 40 exceeds a set temperature threshold, then the automatic thermostat 40 automatically shuts down the portable heater 10 by disconnecting power to the resistive heating element 38.

In some embodiments, the portable heater 10 includes an adjustable thermostat adjusted according to a thermostat switch 44 and the power knob 46. In order to turn on the portable heater 10, a user connects a power cord 58 and turns the power knob 46 from an off position to an on position by rotating the power knob 46 in a clockwise direction. In the illustrated embodiment, turning the power knob 46 in the clockwise direction gradually increases the power supplied to the resistive heating element 38 from 0 Watts to 800 Watts. The user may stop turning the power knob 46 at any point between 0 Watts and 800 Watts to selectively set the power supplied to the resistive heating element 38. In some embodiments, the power knob 46 resists further movement in the clockwise direction when the 800 Watt set point is reached.

To turn off the portable heater 10, the user manipulates a power control that includes a power knob 46 which the user can rotate or turn in the counter-clockwise direction to gradually decrease the power supplied to the resistive heating element 38. The power knob 46 resists further movement in the counter-clockwise direction when the 0 Watt set point is reached. In other words, the portable heater 10 is in the off position. Through this process, the user may manually adjust the power supplied to the resistive heating element 38 and set the power to any value from 0 Watts to 800 Watts. By allowing a seamless transition between 0 Watts to 800 Watts, a user may customize the intensity of the heat supplied by the portable heater 10. The power control may include a potentiometer that allows a continuous selection of intensity settings versus discrete intensity settings.

Figure 5:
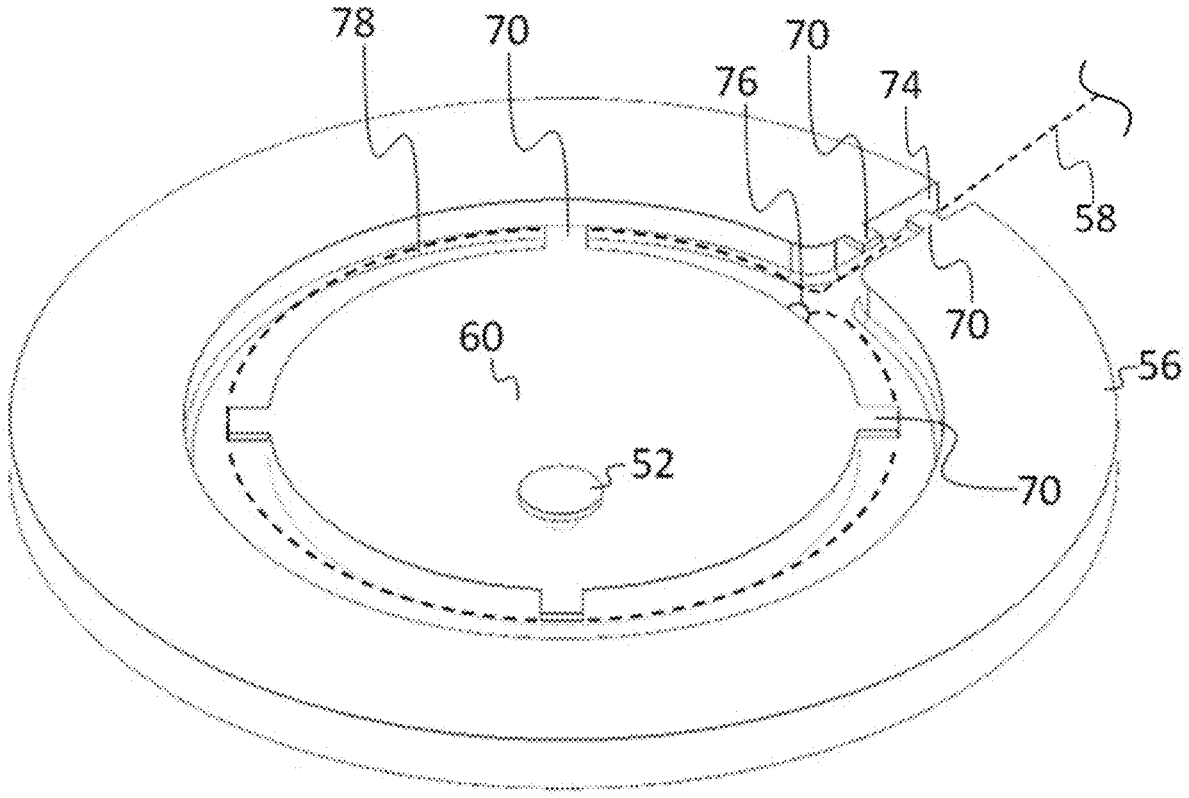
FIG. 5 is a perspective view of a bottom of the base of the embodiment of the portable heater in FIG. 1.

With reference now to FIG. 3 and FIG. 5, the base 12 according to some embodiments of the present disclosure contains a power cord 58 secured between a base plate 56 and the cover panel 80. In one or more embodiments, the base plate 56 is configured to assist with power cord management.

As shown in FIG. 5, in some embodiments, the base plate 56 includes a through-hole 76 through which the power cord 58 extends from an interior of the base 12. The base plate 56 is configured with trenches including a radial trench 74 and a circular trench 78, both of which intersect at the through-hole 76. A user may therefore lay the power cord 58 in the radial trench 74 for a longer deployed portion of the power cord 58 or the user may also lay the power cord 58 in the circular trench 78 for a longer stowed portion of the power cord 58. Each trench includes a first plurality of tabs 70 that extend partially over the trench to help secure the power cord 58 in the trench. In alternative embodiments, a self-retractable reel 67 (FIG. 6) is housed in the base 12 so that any excess or unused portion of the cord may be wound around the reel 67 and safely stored inside the base 12. A user may pull on the portion of the cord outside of the through-hole 76 to either increase the portion of the cord outside of the base 12 or to trigger retraction of the portion of the cord outside of the base 12 for storage inside the base.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. It is understood that the drawings are not necessarily to scale and that any one or more features of an embodiment may be incorporated in addition to or in lieu of any one or more features in another embodiment. Although relative terms such as "outer," "inner," "upper," "lower," "below," "above," "vertical," "horizontal," and similar terms have been used herein to describe a spatial relationship of one element to another, it is understood that these terms are intended to encompass different orientations of the various elements and components of the invention in addition to the orientation depicted in the figures. Additionally, as used herein, the term "substantially," "about," "generally" and similar terms are used as terms of approximation and not as terms of degree, and are intended to account for the inherent deviations in measured or calculated values that would be recognized by those of ordinary skill in the art. Moreover, the tasks described above may be performed in the order described or in any other suitable sequence. Additionally, the methods described above are not limited to the tasks described. Instead, for each embodiment, one or more of the tasks described above may be absent and/or additional tasks may be performed. Furthermore, as used herein, when a component is referred to as being "on" another component, it can be directly on the other component or components may also be present therebetween. It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

What is claimed is:

1. A portable heater comprising:

a ceramic substrate with a heating element configured to define a field of direct radiation;

a heat reflector with a concave reflective surface configured to define a field of reflective radiation; and a grill cover mounted on the heat reflector, wherein the ceramic substrate is mounted on an interior side of the grill cover with the heating element facing the concave reflective surface such that the field of direct radiation onto the concave reflective surface is unobstructed, and wherein the grill cover comprises a plurality of spaced-apart radial rails and a plurality of spaced-apart concentric rails configured to form a screen obstructing objects from being inserted past the grill cover.

2. The portable heater of claim 1, further comprising a wire conduit extending from the ceramic substrate to a periphery of the heat reflector, the wire conduit remaining outside of the field of radiation of the ceramic substrate.

3. The portable heater of claim 1, wherein the grill cover has a predetermined profile and a wire conduit is coextensive with the grill with the predetermined profile.

4. The portable heater of claim 1, wherein the ceramic substrate is supported in its entirety by the grill cover.

5. The portable heater of claim 1, wherein a center axis extends between a center of the ceramic substrate and a center of the heat reflector, and the portable heater is without a support structure extending directly between the ceramic substrate and the heat reflector that is coextensive with the center axis.

6. The portable heater of claim 1, wherein a center axis extends between a center of the ceramic substrate and a center of the heat reflector, and the portable heater is without a support structure that extends directly between the ceramic substrate and the heat reflector and is generally parallel with the center axis.

7. The portable heater of claim 1, wherein the heating element is provided on an inner surface of the ceramic substrate, where the inner surface is generally perpendicular to a center axis extending between a center of the ceramic substrate and a center of the heat reflector.

8. The portable heater of claim 1, wherein the heating element is provided on an inner surface of the ceramic substrate, where the inner surface is without an azimuthal surface relative to a center axis extending between a center of the ceramic substrate and a center of the heat reflector.

9. The portable heater of claim 1, wherein the heating element of the ceramic substrate is positioned to radiate onto a center main portion of the heat reflector without obstruction.

10. A portable heater comprising:

a heat reflector with a concave reflective surface configured to define a field of reflective radiation;

a grill mounted on the heat reflector; and a ceramic substrate with a heating element configured to define a field of direct radiation, wherein the concave reflective surface has a center main portion and the ceramic substrate is mounted on an interior side of the grill with the heating element facing the concave reflective surface such that the center main portion of the concave reflective surface is exposed in its entirety to the field of direct radiation, and wherein the grill comprises a plurality of spaced-apart radial rails and a plurality of spaced-apart concentric rails configured to form a screen obstructing objects from being inserted past the grill.

11. The portable heater of claim 10, wherein the field of direct radiation has generally parallel lines of radiation and the field of reflective radiation has nonparallel lines of radiation.

12. The portable heater of claim 11, wherein the nonparallel lines of radiation includes dispersive lines of radiation outside of the field of direct radiation.

13. The portable heater of claim 10, wherein depending on a distance between the heating element on the ceramic substrate and the heat reflector, the heat reflector is configured so that 90% to substantially all of radiant heat produced by the heating element and directed toward the heat reflector is redirected away from the heat reflector.

14. The portable heater of claim 10, further comprising a wire conduit extending from the ceramic substrate to a periphery location on the heat reflector.

15. The portable heater of claim 10, wherein the grill cover has a predetermined profile and a wire conduit is coextensive with the grill along the predetermined profile.

16. The portable heater of claim 10, wherein the ceramic substrate is supported in its entirety by the grill cover.

17. The portable heater of claim 10, wherein a center axis extends between a center of the ceramic substrate and a center of the heat reflector and the portable heater is without a support structure extending directly between the ceramic substrate and the heat reflector that is coextensive with the center axis.

18. The portable heater of claim 10, further comprising a wire conduit extending from the ceramic substrate to a periphery location on the heat reflector.

19. The portable heater of claim 10, wherein the grill cover has a predetermined profile and a wire conduit is coextensive with the grill along the predetermined profile.

20. The portable heater of claim 10, wherein the ceramic substrate is supported in its entirety by the grill cover.

21. The portable heater of claim 10, wherein a center axis extends between a center of the ceramic substrate and a center of the heat reflector and the portable heater is without a support structure extending directly between the ceramic substrate and the heat reflector that is coextensive with the center axis.

22. A portable heater comprising:

a ceramic substrate with a heating element configured to define a field of direct radiation;

a heat reflector with a concave reflective surface configured to define a field of reflective radiation, the heat reflector having a peripheral rim; and a grill cover mounted on the peripheral rim of the heat reflector, wherein the ceramic substrate is mounted on an interior side of the grill cover with the heating element facing the concave reflective surface such that the field of direct radiation onto the concave reflective surface is unobstructed, and wherein the grill cover comprises a plurality of spaced-apart radial rails and a plurality of spaced-apart concentric rails configured to form a screen obstructing objects from being inserted past the grill cover.

23. The portable heater of claim 22, further comprising a wire conduit extending from the ceramic substrate to a periphery of the heat reflector, the wire conduit remaining outside of the field of radiation of the ceramic substrate.

24. The portable heater of claim 22, wherein the grill cover has a predetermined profile and a wire conduit is coextensive with the grill with the predetermined profile.

25. The portable heater of claim 22, wherein the ceramic substrate is supported in its entirety by the grill cover.

26. The portable heater of claim 22, wherein a center axis extends between a center of the ceramic substrate and a center of the heat reflector and the portable heater is without a support structure extending directly between the ceramic substrate and the heat reflector that is coextensive with the center axis.

27. The portable heater of claim 22, wherein a center axis extends between a center of the ceramic substrate and a center of the heat reflector, and the portable heater is without a support structure that extends directly between the ceramic substrate and the heat reflector and is generally parallel with the center axis.

28. The portable heater of claim 22, wherein the heating element of the ceramic substrate is positioned to radiate onto a center main portion of the heat reflector without obstruction.

* * * * *